United States Patent [19]

Helzer

[11] 4,364,537

[45] Dec. 21, 1982

[54] ADJUSTABLE PLATE HOLDER

[75] Inventor: James A. Helzer, Cheyenne, Wyo.

[73] Assignee: Unicover Corporation, Cheyenne, Wyo.

[21] Appl. No.: 186,320

[22] Filed: Sep. 11, 1980

[51] Int. Cl.[3] ..... A47B 97/04

[52] U.S. Cl. ..... 248/448; 248/488

[58] Field of Search ..... 248/448, 449, 477, 478, 248/488, 490, 452, 453

[56] References Cited

U.S. PATENT DOCUMENTS

| | | | |
|---|---|---|---|
| 1,869,714 | 8/1932 | Rodack | 248/453 |
| 2,501,019 | 3/1950 | Attick | 248/448 |
| 2,565,014 | 8/1951 | Beaty | 248/449 |
| 2,696,962 | 12/1954 | Goss | 248/477 |
| 2,987,832 | 6/1961 | Urbain et al. | 248/477 |
| 3,363,871 | 1/1968 | Slazik et al. | 248/477 |
| 3,749,349 | 7/1973 | Kaplan | 248/488 |
| 4,223,864 | 9/1980 | Harlow | 248/490 |

*Primary Examiner*—Francis K. Zugel

*Attorney, Agent, or Firm*—Larson and Taylor

[57] ABSTRACT

An adjustable holder for a planar object such as a plate is disclosed. The holder is comprised of a base having a channel therein in which an arm is received. The arm is frictionally held in the channel of the base and has a hooked upper end. At the lower part of the base, means to removably attach a pair of feet is provided. Where the holder is to be freestanding, the pair of feet extend forwardly and sidewardly of the base. Where the holder is to be mounted on a wall, an alternative pair of feet is provided which extend downwardly as well as forwardly and sidewardly.

3 Claims, 13 Drawing Figures

ADJUSTABLE PLATE HOLDER

FIELD OF THE INVENTION

This invention relates generally to an adjustable holder for mounting a planar object and more particularly to a holder having outwardly extending legs and an adjustable arm for mounting a plate.

BACKGROUND OF THE INVENTION

A number of devices have been disclosed in the prior art for the holding of a planar object such as a plate. For example, in U.S. Pat. Nos. 213,264 to Vizet, 2,365,108 to Richards, and 3,788,589 to Schulze, an adjustable plate holder having two lower brackets and an upper bracket is disclosed. Other devices disclosed in the prior art, such as those disclosed in U.S. Pat. Nos. 2,905,412 to Kipp and 2,634,936 to Meline, have only a top and bottom bracket. Other types of holders for planar objects which act as easels are disclosed in the following U.S. Pat. Nos. 679,530 to Kaminski (plate); 3,282,437 to Hansen (dish); 3,140,558 to Cassidy (book or magazine); 3,007,278 to Million (book); and 3,799,488 to Sena (artist's canvas frame). An easel-like device for holding a clock which is convertible to a wall hanging device is disclosed in U.S. Pat. No. 1,136,520 to Fukami There are a number of disadvantages associated with the holder devices such as those disclosed above. For example, with the exception of the device disclosed in the Fukami patent, the holder is not convertible from a wall mounted to a freestanding holder. In addition, where the devices are adjustable, the adjustment mechanism may come loose and release the article being held.

SUMMARY OF THE INVENTION

In accordance with the present invention, an adjustable apparatus is provided for mounting a planar object such as a plate. The holder has a longitudinal base having a channel therethrough. An arm having a hooked end is frictionally received in the channel so as to be adjustable longitudinally of the channel. At the lower end of the base, a means to attach a pair of feet is provided. If the holder is to be freestanding, a pair of feet which extend forwardly and sidewardly is provided. If the holder is to hang from a wall, a pair of feet is provided which extend downwardly as well as forwardly and sidewardly.

According to a preferred embodiment, the channel provided in the base is elongate and is substantially rectangular in transverse cross section. Two raised portions are provided along each side of the rectangular channel so that a close frictional fit with the arm is provided at these locations.

Other features and advantages of the present invention are stated in or are apparent from the detailed description of a presently preferred embodiment of the invention found hereinbelow.

DETAILED DESCRIPTION OF THE PREFERRED EMBODIMENT

Figures 1, 2, 3, 4, 5, 6, 7, 8, 9, 10, 13:
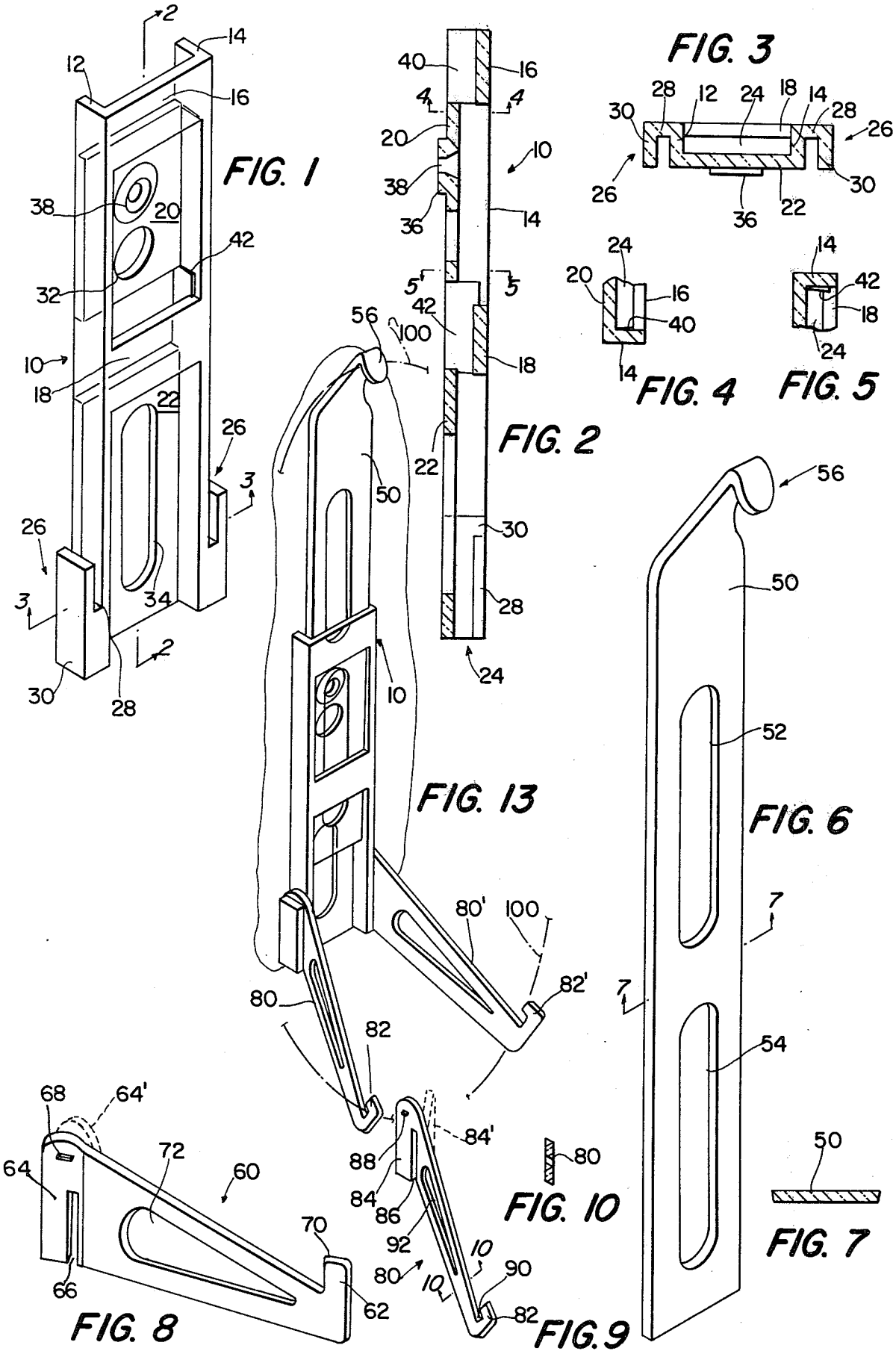
FIG. 1 is a perspective view of a base of the present invention.
FIG. 2 is a cross-sectional view of the base depicted in FIG. 1 taken along the line 2—2.
FIG. 3 is a cross-sectional view of the base depicted in FIG. 1 taken along the line 3—3.
FIG. 4 is a partial cross-sectional view of a portion of the base taken along the line 4—4 in FIG. 2.
FIG. 5 is a partial cross-sectional view of a portion of the base taken along the line 5—5 in FIG. 2.
FIG. 6 is a perspective view of an arm of the present invention.
FIG. 7 is a cross-sectional view of the arm depicted in FIG. 6 taken along the line 7—7.
FIG. 8 is a perspective view of one embodiment of a foot of the present invention.
FIG. 9 is a perspective view of a second embodiment of a foot of the present invention.
FIG. 10 is a cross-sectional view of the foot depicted in FIG. 9 taken along the line 10—10.
FIG. 13 is a perspective view of an alternative embodiment of an assembled plate holder of the present invention.

With reference now to the drawings in which like numerals represent like elements throughout the several views, a presently preferred embodiment of a base 10 of the present invention is depicted in FIGS. 1, 2 and 3. Base 10 is comprised of two sides 12 and 14, two front panels 16 and 18, and two rear panels 20 and 22. As shown best in FIG. 3, a channel 24 is provided along the longitudinal length of base 10 between sides 12 and 14, under front panels 16 and 18, and above rear panels 20 and 22. Channel 24 is substantially rectangular in cross section and extends along the entire length of base 10. At the bottom of base 10 located on sides 12 and 14 are two mounting brackets 26. Each mounting bracket consists of a key 28 which is attached along a portion of a respective side 12 or 14. Each key 28 spaces a flange 30 which is larger than key 28 parallel to sides 12 and 14. Rear panels 20 and 22 include hollowed out portions 32 and 34, respectively. Rear panel 20 also includes a thickened portion 36 in which a tapered screw receiving hole 38 is located as shown best in FIG. 2. Where a screw is inserted in hole 38, the head of the screw fits into the tapered portion so that the screw does not project into channel 24 at all. Both sides 12 and 14 include two slightly raised portions such as raised portions 40 and 42 shown in FIG. 2. Raised portion 40 is shown in more detail in FIG. 4, where it is also shown that side 14 has a greater thickness at the rear than at the front so that channel 24 is slightly trapezoidal in cross sectional shape. FIG. 5 shows raised portion 42 and also the trapezoidal shape of channel 24.

Depicted in FIG. 6 is an elongate arm 50 which is received in channel 24 of base 10. Where channel 24 is trapezoidal in shape, arm 50 is correspondingly trapezoidal in cross sectional shape as shown in FIG. 7. Arm 50 also includes two hollowed out portions 52 and 54 which may be similar to the hollowed out portions 32 and 34 of base 10. Located at the upper end of arm 50 is a hooked end portion 56. As shown, hooked end portion 56 extends slightly forward.

Depicted in FIG. 8 is a foot 60 having a toe 62 and an offset flange 64. Offset flange 64 is bent at an angle of approximately 20 to 35 degrees, and preferably between 25 to 30 degrees, from the main portion of foot 60. A slot 66 having substantially the same size as key 28 of base 10 is located in offset flange 64. Above slot 66 on offset flange 64 is a protrusion 68. Face 70 of toe 62 which faces inward is also slanted at approximately the same angle as offset flange 64 is bent so that the plane of face 70 is perpendicular to the plane of offset flange 64. Foot 60 also includes a hollowed out portion 72 located between toe 70 and offset flange 64. Foot 60 is one of a pair of feet, the other foot being the mirror image of foot 60 so that the other foot has an offset flange 64' (shown in phantom) which is bent at the same angle but in the opposite direction from offset flange 64 and a face 70' (FIG. 11) which is perpendicular to offset flange 64'.

Depicted in FIG. 9 is a second type of foot 80 having a toe 82 and an offset flange 84. Foot 80 differs from foot 69 in that the body of foot 80 projects downward from offset flange 84 at an angle of approximately 45 degrees. Otherwise, foot 80 is similar to foot 60 and has a slot 86 and protrusion 88 on offset flange 84. Offset flange 84 is bent at approximately the same angle as offset flange 64, and face 90 of toe 82 is slanted so as to be perpendicular to offset flange 84. Foot 80 also includes a hollowed out portion 92. As foot 80 is angled downwardly, and it is desired to have toe 82 vertical, the shape of the body portion of foot 80 takes on the cross-sectional shape of a parallelogram as shown in FIG. 10. In addition, toe 82 is provided with more of a hook shape. As with foot 60, foot 80 is only one of a pair of feet which are mirror like in construction. The other foot has offset flange 84', which is an equal distance but oppositely directed from offset flange 84. Also, face 90' (FIG. 12) of the other foot is likewise perpendicular to offset flange 84'.

Figure 11:
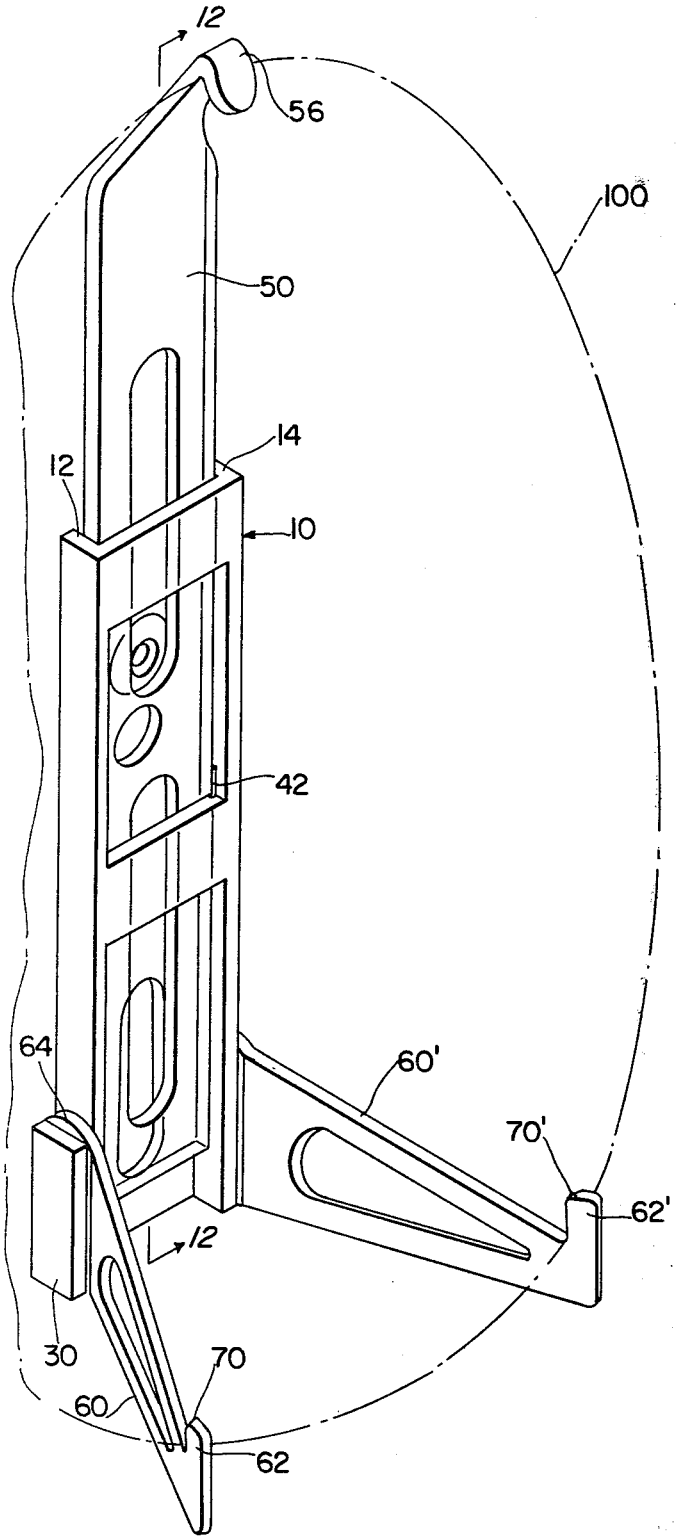
FIG. 11 is a perspective view of the assembled plate holder of the present invention.
Figure 12:
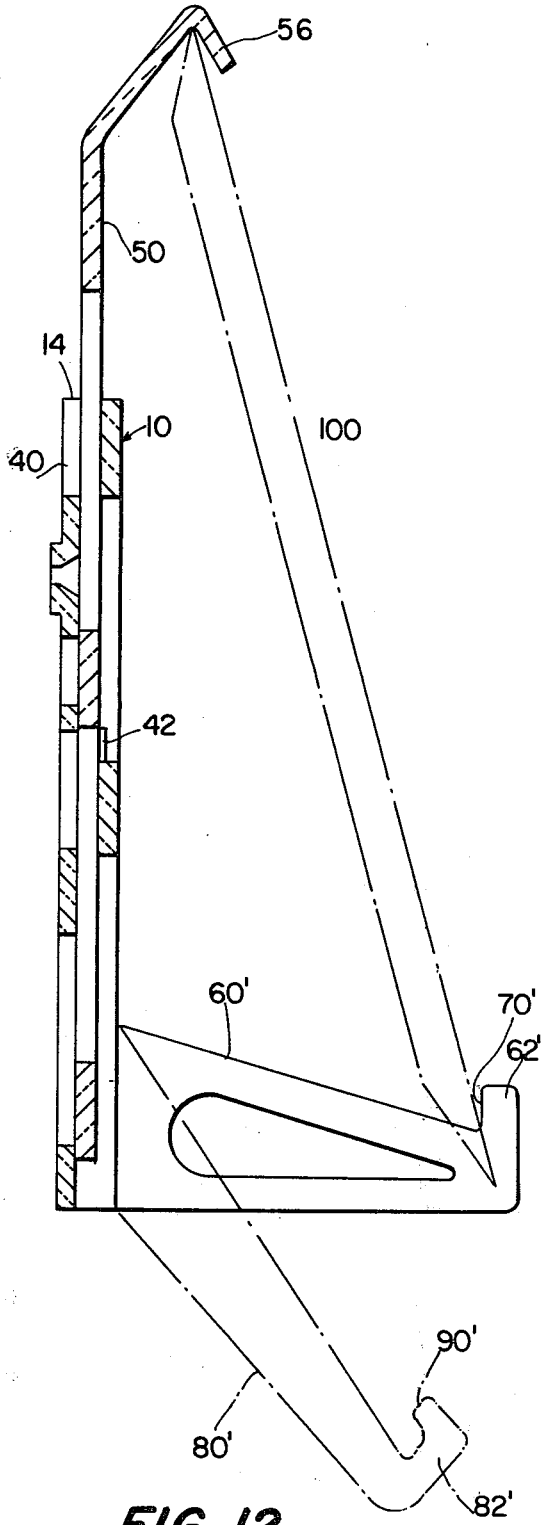
FIG. 12 is a cross-sectional view of the plate holder depicted in FIG. 11 taken along the line 12—12.

In use, the adjustable plate holder of the present invention functions in the following manner as depicted in FIGS. 11, 12 and 13. As shown in FIGS. 11 and 12, where the adjustable plate holder is placed on a level surface, feet 60 and 60' are used. Foot 60 is mounted on base 10 by sliding offset flange 64 behind flange 30 as key 28 is received in slot 66. Protrusion 68 on offset flange 64 causes foot 60 to be frictionally locked in place. Once in place, foot 60 extends forwardly and outwardly from base 10 at the same level as the bottom of base 10. In this manner, the adjustable plate is free-standing. Next, arm 50 is inserted into channel 24 of base 10. By adjusting the position of arm 50, a plate 100 (shown in phantom) can be located between hooked end portion 56 of arm 50 and the toes 62 and 62' of feet 60 and 60'. Arm 60 is frictionally held in channel 24 by means of raised portions 40 and 42. As shown in FIG. 12, face 70' of toe 62' is parallel with base 10 such that plate 100 rests across the width of face 70.

If it is desired to hang the adjustable plate holder upon a wall, feet 60 and 60' are replaced with feet 80 and 80'. As shown in FIG. 13 and in phantom in FIG. 12, feet 80 and 80' extend downwardly from base 10 as well as forwardly and sidewardly. By extending downwardly, feet 80 and 80' mount plate 100 lower with respect to base 10 than feet 60 and 60'. In this embodiment, the horizontal distance between the face member and toes of the feet of the device is preferably less than in the embodiment of FIG. 11 since it is usually desirable that a wall-mounted plate be positioned more vertically whereas it is usually desirable that a standing plate is positioned at a substantial inclination to the vertical. Plate 100 is mounted in the adjustable plate holder in the same manner as with feet 60 and 60'. Prior to the mounting of plate 100, base 10 is attached to the wall by means of a screw passing through tapered hole 38 in base 10. Next, feet 80 and 80' are attached to base 10 and arm 50 is inserted in channel 24. Thus, arm 50 can be lowered to engage plate 100 resting in the toe portions 82 and 82' of feet 80 and 80'.

In the preferred embodiment of the present invention, base 10, arm 50, feet 60 and 60', and feet 80 and 80' are all made from a clear plastic material such as polycarbonate or acrylic. In this manner, the adjustable plate holder is completely transparent and the small portions of the adjustable plate holder which extend in front of the plate, hooked end 56 and the toes of the feet, do not distract from the appearance of the plate which is being mounted. It should be noted that the adjustable plate holder can be manufactured in a variety of sizes to mount a variety of diverse plate sizes. Thus, one size of the present invention may be suitable for a ten inch or twelve inch plate, while a different size may be provided for a 24 inch serving platter. It should also be appreciated that different sized and shaped hollowed out portions can be provided to reduce the material used in making the adjustable plate holder and to enhance the appearance of the adjustable plate holder.

Thus, while the invention has been described in detail with respect to an exemplary embodiment thereof, it should be understood by those of ordinary skill in the art that these and other variations and modifications may be effected in the exemplary embodiment within the scope and spirit of the invention.

I claim:

1. An adjustable holder for supporting three side surfaces of a planar object, such as the top edge portion and two lower edge portions of a plate, comprising:

a rigid supporting base having two parallel longitudinal sides, at least one front panel, and at least one back panel, said front panel being attached at the forward edges of said two sides and said back panel being attached at the rearward edges of said two sides so that a substantially quadrilateral channel is provided along the longitudinal length of said base between said two sides, said front panel and said rear panel;

an elongate arm having a substantially quadrilateral cross-section so as to be frictionally received in the channel of said base, the upper portion of said arm being provided with a downwardly and forwardly projected hooked end;

a pair of feet extending forwardly and sidewardly of said base on either side of said base, each said foot having an upstanding toe at the outwardly extending end;

means to removably attach said pair of feet to the lower end of said base including a mounting bracket on each of said sides of said base, said mounting bracket having a key which is attached along a portion of a respective side which spaces a flange parallel to said sides; and each said foot including a slot near the end opposite said toe, said slot being substantially the same size as said key and adapted to be received by said key, and a protrusion located above said slot on said foot, said protrusion fitting between said respective side and flange to reduce the play between said foot and said mounting bracket and such that a plate resting against said toes is locked in place by lowering said arm in the channel until said hooked end of said arm engages the top of the plate and said arm is then frictionally held in place.

2. An adjustable holder which is convertible from a free-standing holder to a wall-mounted holder for supporting three side surfaces of a planar object, such as the top edge portion and two lower edge portions of a plate, comprising:

a rigid supporting base having two parallel longitudinal sides, at least one front panel, and at least one back panel, said front panel being attached at the forward edges of said two sides and said back panel being attached at the rearward edges of said two sides so that a substantially quadrilateral channel is provided along the longitudinal length of said base between said two sides, said front panel and said rear panel;

an elongate arm having a substantially quadrilateral cross section so as to be frictionally received in the channel of said base, the upper portion of said arm being provided with a downwardly and forwardly projecting hooked end;

a first pair of feet which extend forwardly and sidewardly when attached to said base, each said first foot having an upstanding toe at the outwardly extending end;

a second pair of feet which extend forwardly, sidewardly and downwardly when attached to said base, each said second foot having an upstanding toe at the outwardly extending end;

means to attach said base to a wall; and means to removably attach said first and second pair of feet to the lower end of said base such that where said holder is freestanding said first pair of feet are attached to said base, and such that when said holder is attached to a wall, said second pair of feet are attached to said base, whereby a plate resting against said toes is also held in place by lowering said arm in the channel until said hooked end of said arm engages the top of the plate and said arm is then frictionally held in place.

3. An adjustable holder as claimed in claim 2 wherein said arm has a trapezoidal cross sectional shape and said channel of said base is also trapezoidal in cross section so as to receive said arm therein.

* * * * *